United States Patent [19]

Kasuga

[11] 4,033,273

[45] July 5, 1977

[54] SEWING MACHINE

[75] Inventor: Noboru Kasuga, Hachioji, Japan

[73] Assignee: Janome Sewing Machine Co., Tokyo, Japan

[22] Filed: Apr. 17, 1975

[21] Appl. No.: 569,178

[30] Foreign Application Priority Data

| | | |
|---|---|---|
| Apr. 20, 1974 | Japan | 49-43894 |
| Apr. 20, 1974 | Japan | 49-43895 |
| Apr. 20, 1974 | Japan | 49-43896 |
| Apr. 20, 1974 | Japan | 49-44131[U] |
| Apr. 20, 1974 | Japan | 49-48270 |

[52] U.S. Cl. ..... 112/274; 112/275; 112/279

[51] Int. Cl.[2] ..... D05B 69/00

[58] Field of Search ..... 112/219 A, 219 R, 220, 112/67, 87

[56] References Cited

UNITED STATES PATENTS 3,788,250 1/1974 Soeda ..... 112/219 A

*Primary Examiner*—H. Hampton Hunter
*Attorney, Agent, or Firm*—Michael J. Striker

[57] ABSTRACT

A sewing machine operated by a foot controller is provided with a mechanism for stopping the main shaft of the sewing machine in a predetermined position of each revolution thereof, thus to intermittently drive the sewing machine to produce intermittent stitches. The mechanism can be made inoperative allowing the main shaft to continuously rotate, thereby to produce the ordinary continuous stitches.

6 Claims, 15 Drawing Figures

SEWING MACHINE

With the recent wide spread of zigzag sewing machines and with the advance in mechanism as well as in its function, it has become desirous that the sewing machine could be intermittently driven to make intermittent stitches, besides the conventional function of the sewing machine to produce the ordinary continuous stitches.

The present invention has been devised to realize a sewing machine which can produce intermittent stitches without any adverse influence to the conventional functions of the sewing machine.

The primary object of the invention is to provide a sewing machine with a stopping device for stopping the main shaft of the sewing machine in a predetermined position, so that the needle of the sewing machine may be stopped in a predetermined position at each revolution of the main shaft.

Another object of the injection is to provide a selecting device for selecting an ordinary continuous stitching operation of high or low speed and an intermittent stitching operation of sewing machine. means A still further object of the invention is to provide a foot controller and an electric control circuit for operating the machine stopping device of the invention, which is pressed down to stop the main shaft of the sewing machine after one revolution thereof and is released to allow the main shaft to make the next revolution.

Many other features and characteristics of the present invention will be apparent from the following description of the embodiment of the invention by reference to the attached drawings, in which, FIG. 1 is a perspective view of the sewing machine and machine controller of the present invention.

DETAILED DESCRIPTION OF THE INVENTION

Figure 1:
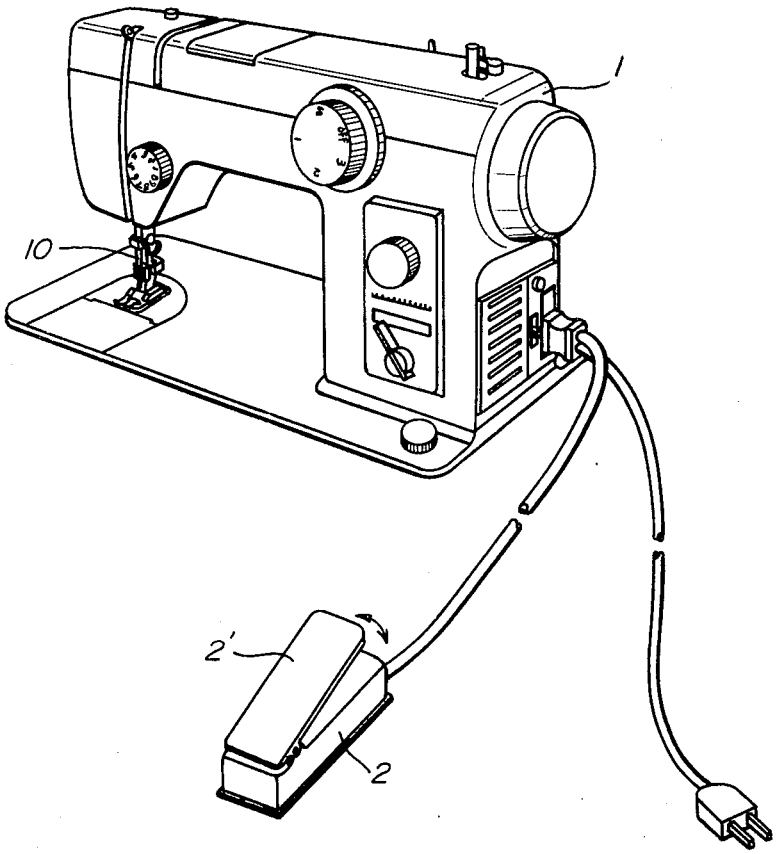
Figure 2:
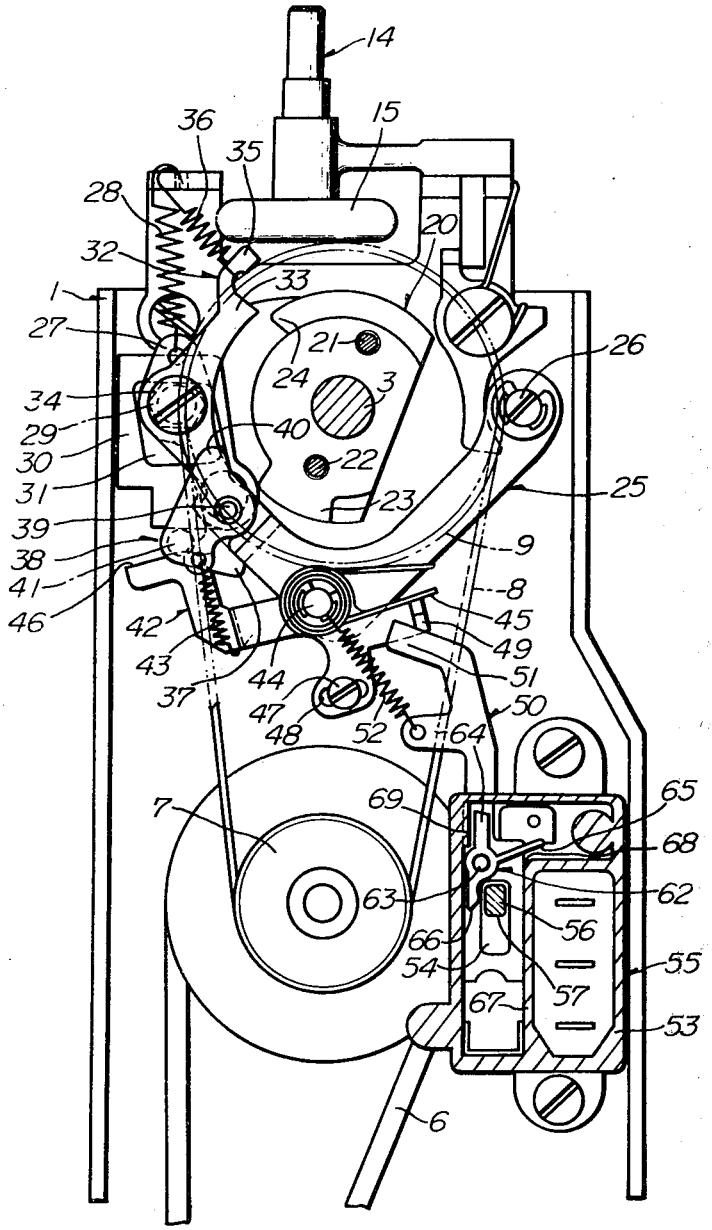
FIG. 2 is a partly sectioned rear view of the sewing machine showing a device for stopping the main shaft of the sewing machine in a predetermined position which is set to operate the sewing machine to produce the normal stretch stitching.
Figure 3:
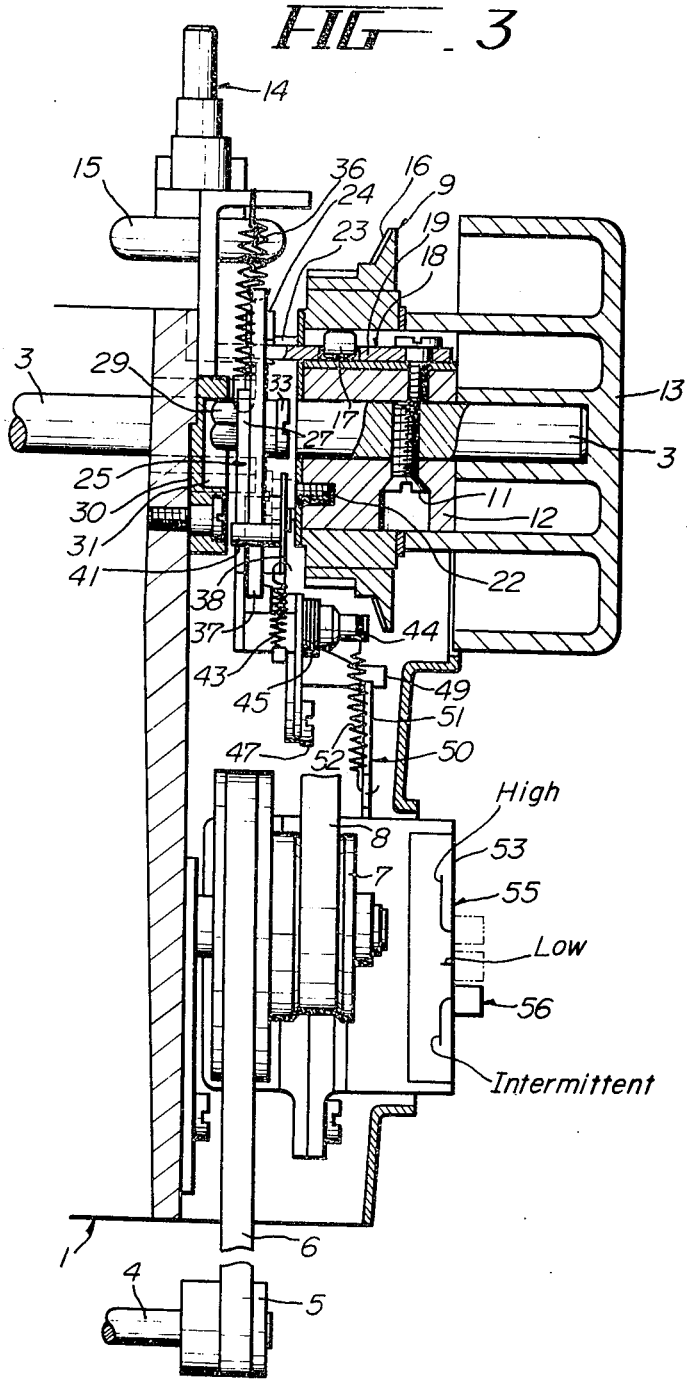
FIG. 3 shows the machine stopping device of the invention partly in a vertical cross section.

The invention will be explained with reference to the attached drawings. In FIGS. 1 to 8, which show the first embodiment of the invention, a sewing machine 1 is provided with a controller 2 having a pedal 2'. Upper shaft 3 is journalled in the machine frame and is rotated in the counterclockwise direction, as viewed in FIG. 2, by a motor 4 via a rotary shaft 4' of the motor 4, motor pulley 5, first belt 6, intermediate pulley 7, second belt 8 and a pulley 9 of the upper shaft 3. The needle is vertically reciprocated in the well known manner by rotation of the upper shaft 3. The pulley 9 is connected to the upper main shaft 3 by means of an intermediate bushing 12 fixedly connected to the upper main shaft and a clutch device which will be decribed hereinafter. Flywheel 13 is fixedly mounted on the end of the upper shaft 3 as shown in FIG. 3. Rubber ring 15 or a ring of frictinal material of the thread winding device 14 is adapted to be pressed against the flange face 16 of the pulley 9 to thereby be rotated to wind a thread on a bobbin (not shown) mounted on the shaft of the thread winding device 14. Number 18 denotes a clutch operable to allow the rotation of the pulley 9 relative to the upper shaft 3 when the thread winding device 14 is shifted to the operative position to wind a thread on the bobbin, and the clutch is composed of a roller 17 and a clutch lever 19 which prevents the roller from shifting from its fixed position.

Stop cam member 20 is fixed on the inner side of bushing 12 by means of screws 21 22 to rotate with the upper shaft 3, and is formed with a cam portion 23 and portion. And arranged substantially diametrically opposite cam portion 23.

Figure 13:
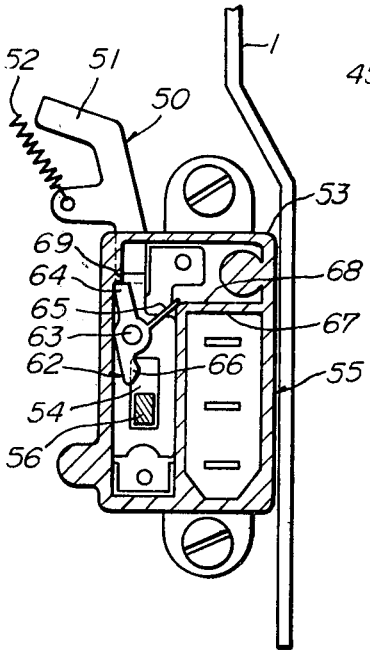
FIG. 13 is a vertical cross section along line Y — Y of FIG. 12.

A holder 25 is turnably mounted on at its one end on a screw 26 fixed to the machine frame, is pulled at its other end 27 by a spring 28 in the clockwise direction, and is held in a stopped position by means of a nut 29 mounted on the free end part and inserted in a square hole 31 of stop 30 which is fixed to the machine frame as shown in FIG. 3. Number 32 denotes a pawl which is at its intermediate portion turnably mounted in the holder 25 by means of screw 34 and the nut 29, and is pulled at the upper end 35 thereof by spring 36 in the counterclockwise direction around the screw 34. A face 33 in the region of the upper end of the pawl 32 engages the cam portion 24 of stop cam member 20 when the holder 25 is rotated in the clockwise direction. A lower portion 37 of the pawl 32 contacts the holder 25, and thus the pawl is held in a stopped position. Actuating member 38 is turnably mounted on an axis 39 fixed to the lower part of the pawl 32. The actuating member 38 is formed with a contacting portion 40 as shown and the contacting portion is adapted to engage the cam portion 23 of the stop cam member 20. A pin 41 is provided on the actuating member 38. When the pin 41 is pushed upwards, the member 38 is turned in the clockwise direction around the axis 39 and as the result, the contacting portion 40 is moved to engage the cam portion 23. When the machine is set to the ordinary continuous stitching, the actuating member 38 is biased in the counterclockwise direction by a spring 43 provided between the member 38 and lever 42, and the contacting portion 40 is kept away from the cam portion 23 of the stop cam member 20. Lever 42 of the shape as shown is at its intermediate portion turnably mounted on an axis pin 44 provided on the intermediate portion of the holder 25, and is biased in the clockwise direction by torsion spring 45. When the machine is set to the ordinary continuous stitching, the flat portion 46 at one end of the lever 42 slightly engages the pin 41 of the actuating member 38 or is kept away therefrom. Further this lever 42 is divided in two parts and these parts are adjustably connected by a screw 47 threaded into holes 48 at both end portions of the parts. The upper end portion 51 of lever 50 presses against the other end portion 49 of the lever 42 against the torsion spring 45 as shown in FIG. 2. As the lever 50 is pulled upwards by a spring 52 provided between the lever 50 and the pivot pin (44) of the lever 42, the lever is kept in a predetermined position. The lower portion of the lever 50 projects into a plug receptacle box 53 (FIG. 13). A vertical slot 54 is provided in the lower portion of the lever 50 and within this slot 54 a manually operated portion 56 of a selector switch 55 is inserted. Thus when the portion 56 is depressed until the undersite thereof engages the lower edge of the slot 54 in the lever 50 and depresses the lever 50, the lever 50 is downwardly shifted against the spring force of 52. This downward movement of the lever 50 actuates the machine stopping device as will be explained later on in detail.

Figure 9:
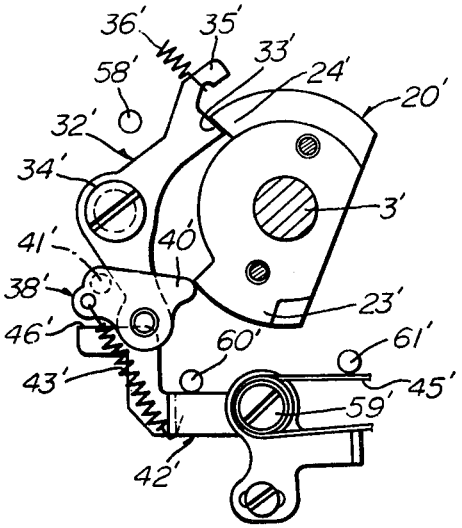
FIGS. 9 to 11 show another embodiment of the machine stopping device of the invention in various operating positions.
Figure 10:
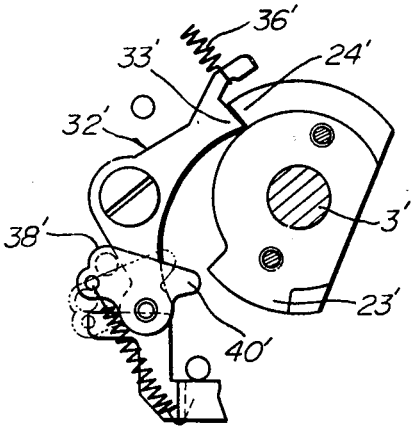
Figure 11:
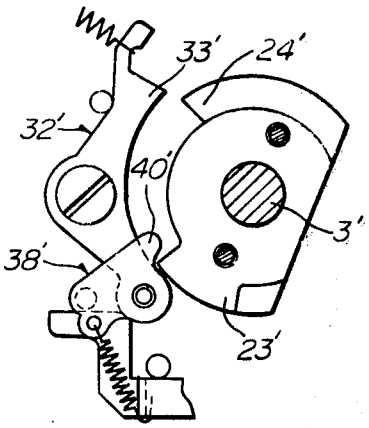

With reference to FIGS. 9 to 11, which show a second embodiment of the machine stop device, stopper cam member 20' and cam portions 23' and 24' are the same as those in the first embodiment. However, the difference is that the holder 25 is eliminated in that embodiment. Instead, the pawl 32' is turnably mounted on the sewing machine 1 by means of screw 34' and its upper portion 35' is pulled by a string 36' to turn in the counterclockwise direction, and is maintained at a stopped position by a pin 58 fixed to the machine frame. The pawl 32' is adapted to engage the cam portion at its upper engaging face 33'. The actuating member 38' on which a pin 41' is mounted, is turnably mounted on the lower part of the pawl 32'. The contacting portion 40' of the actuating member 38' is adapted to engage the cam portion 23' of stop cam member 20' during the clockwise turning movement of the lever 42' which is turnably mounted on the machine frame by screw 59', in the same manner as in the first embodiment. In this connection the actuating member 38' is biassed by a spring 43' in the counterclockwise direction. The lever 42' is pressed by a spring 45' to turn in the clockwise direction, and its turning movement is limited by a pin 60 fixed to the machine frame. The spring 45' contacts, at its one end, a pin 61 secured to the sewing machine 1, and contacts at its other end, one arm of the lever 42'.

Figure 12:
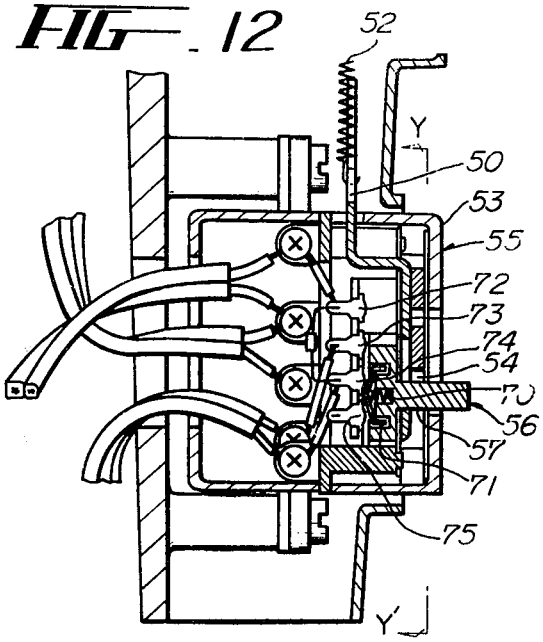
FIG. 12 shows a selecting device in vertical cross section for selecting the ordinary continuous stitching at high or low speed and intermittent stitching.

The selecting device for selecting the ordinary continuous stitching and the intermittent stitching will be explained, referring to FIGS. 12 and 13.

Figure 15:
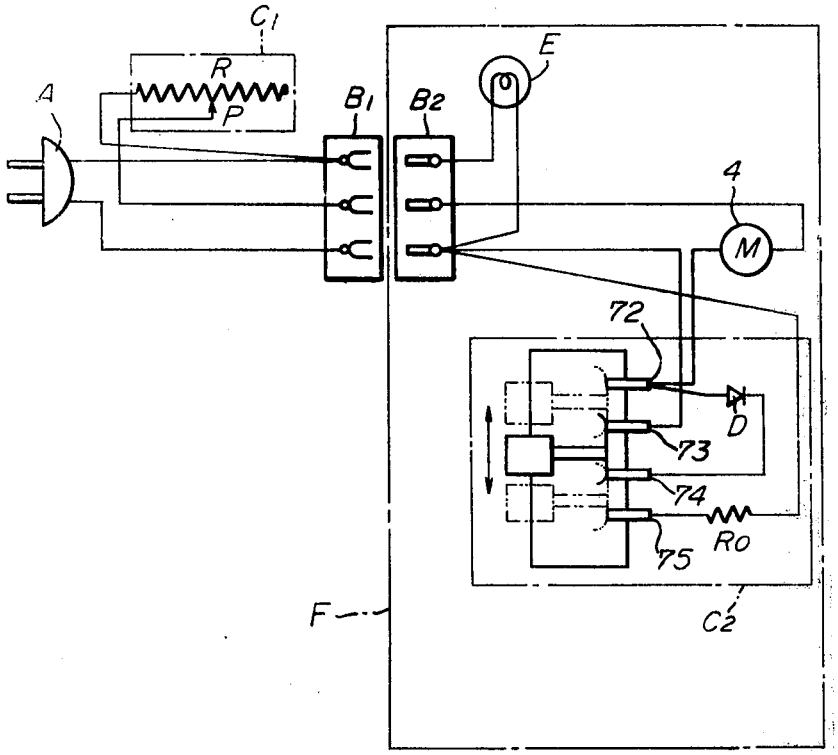
FIG. 15 is an electrical circuit of the invention.

The selecting switch 55 and manually operating portion 56 are provided for this purpose. The operating portion may be moved stepwise to three positions such as "High," "Low" and "Intermittent" as shown in FIG. 3. When the operating portion 56 is set to High position, A.C. voltage of 0 to 100V is supplied to the motor 4 through the controller 2 from A.C. source as shown in FIG. 15. When the operating portion 6 is set to Low position. D.C. half wave voltage or 0 to about 70V is supplied to the motor through the controller 2 and diode (D). When the operating portion 56 is set to Intermittent position, the lever 50 is moved down together with the operating portion and the needle stopping device is actuated, and concurrently D.C. half wave voltage of 0 to about 60V is transmitted to the motor through the controller 2, diode (D) and resistor ($R_0$) connected in series to the circuit for the motor (this circuit formation may be made common to the circuit in case of Low stitching). Number 62 (FIG. 13) denotes an element to retain the lever 50 in a lower position. The element is pivoted on the lower part of the lever by means of a pin 63 and is formed with a projection 64 and spring 65 at its upper portion and further with a cam 66 at its lower portion to engage the operating portion 56. The projection 64 prevents the lever 50 from being pulled up by tension of the spring 52 when the lever 50 has been lowered. When the element 62 goes down together with the lever 50, the spring 65 of the element 62 is pressed against a shoulder 68 of dividing wall 67 within the plug receptacle box 53 and the element 62 is rotated in the counterclockwise direction and then the projection 64 engages a step 69 in the plug receptacle box. When the operating portion 56 is at the upper part of the slot 54, the cam 66 of the element 62 is pressed against the operating portion as shown in FIG. 2. When the operating portion 56 is moved to the lower part of the slot 54, the cam 66 of the element 62 enters the for the operating portion 56 within the slot 54 as shown in FIG. 13. On the other hand, when the operating portion 56 is moved up, the cam 66 of element 62 is engaged by the operating portion 56 and the element is turned in the clockwise direction, so that the projection 64 is released from the step 69 and the lever 50 is pulled upwards by the spring 52. When the operating portion 56 is moved to the steps of High and Low the lever 50 can be operated with a comparatively weak pressing force. But when the operating portion 56 is moved down to the lower position exceeding Low position, the operating portion 56 has to overcome the resistance of spring 52 as well as spring 65, and therefore, much greater pressing force is required (actually around 200g). The operating portion 56 is in a shape as shown in FIG. 12. A contact 71 is suitably pressed against terminals 72, 73, 74 and 75 as is vertically movable together with the operating portion 56. When the contact 71 engages terminals 72, 73, the machine is set to a high speed ordinary continuous stitching and when the contact 71 engages terminals 73, 74, machine is set to a low speed ordinary continuous stitching and when the contact engages terminals 74, 75, the machine is set to an intermittent stitching.

Figure 14:
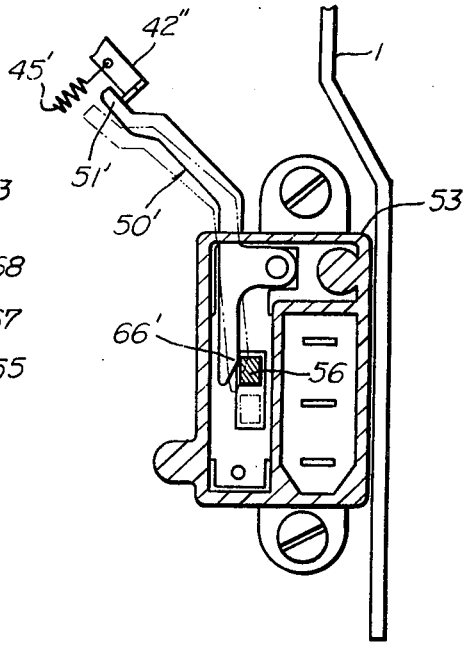
FIG. 14 is another embodiment of the selecting device of the invention.

If the low speed ordinary continuous stitching function is not required, the lever 50' can be made oscillatory around an intermediate pivot thereof, as shown is FIG. 14 and the vertical movement of the operating portion 56 is made to impart oscillatory movement to the lever 50' in such a manner that the portions 56 engages or releases the lower end 66' of the lever 50' during the vertical movement thereof. Thus the upper end 51' of the lever 50' can press against the lever 42' against the action of spring 45' or releases the lever 42''. Such a structure may, of course, be appliable to the three kind of stitching operations of the present invention FIG. 15 is an electric circuit according to the invention in which (A) denotes a plug to be fitted to the power source. ($C_1$) denotes a controlling element for the machine controller having variable resistor (R) and slider (P). ($B_1$) is connector of the machine controller (F) is an elctric control circuit furnished in the sewing machine and ($B_2$) is a connector of the control circuit. (E) is an illumination lamp, (M) is a motor ($C_2$) is the controlling element in the sewing machine and numeral 56 denotes a manually operating portion and numerals 72, 73, 74 and 75 denote switch contacts, which are all corresponding to those as shown in FIG. 12. (D) is a diode, ($R_0$) is a resistor.

The operation of the proposed device will now be discussed.

The ordinary continuous stitching will be explained with reference to FIG. 2. Namely when the operating portion 56 of the switch 55 is set to High or Low, the lever 50 is pulled upwards by the spring 52 to rotate the lever 42 in the counterclockwise direction against the spring 45 so that the lever 42 will not act on the actuating member 38. In this instance, the lever 42 causes the actuating member 38 to turn in the counterclockwise direction by means of spring 43. The contacting portion 40 of the actuating member 38 is, therefore, kept out of the passage of cam portions 23 of stop cam member 20 so that the stop cam member can be freely rotated by the main shaft 3 of the sewing machine. In this connection, the pawl 32 is not rotated in the clockwise direction by the actuating member 38 and is held in the inoperative position by the spring 36. The holder 25 is pulled by the spring 28 in the clockwise direction and the upper part of the nut 29 contacts the upper edge of the square hole 31. Thus the upper shaft 3 freely and continuously rotates to produce the stretch stitches at an optional speed by pressing the machine controller 2.

Now, the intermittent stitching is discussed. When the operating position 56 of the switch 55 is set to Intermittent D.C. half wave voltage of 0 to about 60V is supplied to the motor 4 and accordingly the sewing machine is not rotated at high speed but rotated at low speed even if the controller 2 is pressed down to the maximum degree. In the meantime, when the operating portion 56 is moved downwardly and set as shown in FIG. 13, the lever 50 goes down, and the spring 65 of the element 62 touches the shoulder 68 of the dividing wall 67 within the plug receptacle box 53 and the element 62 is rotated in the counterclockwise direction and the upper part of the projection 64 engages the step 69 of the box 53, and the lever (50) is prevented from rising and held in the lower position. Then, the lever 42 is rotated in the clockwise direction by pressure of the spring 45 until it is stopped by the holder 25, and the flat portion 46 at one end of the lever 42 pushes up the pin 41 to rotate the actuating member 38 in the clockwise direction against tension of the spring 43 so that the contact portion 40 of the member 38 is shifted into the path of the cam portion of the stop cam member 20. The clockwise turning movement of the lever 42 is stopped as the corner of the flat end portion 46 of the lever 42 contacts the opposing face of the holder 25.

Figure 5:
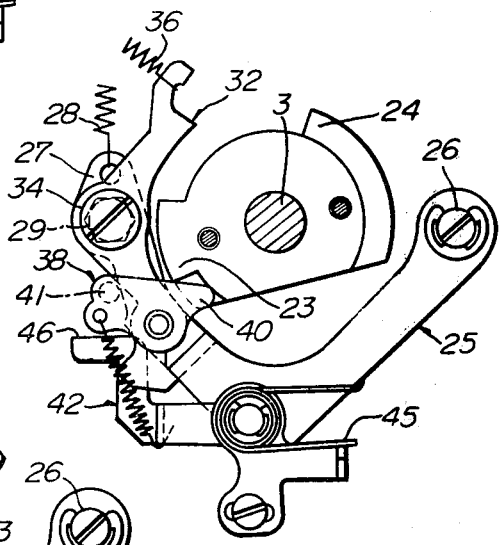
Figure 6:
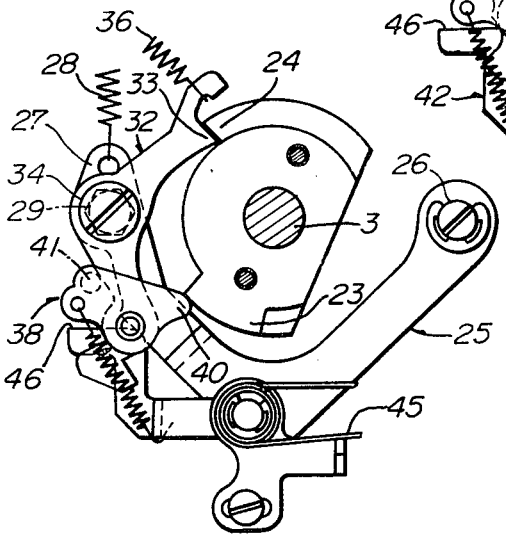
Figure 7:
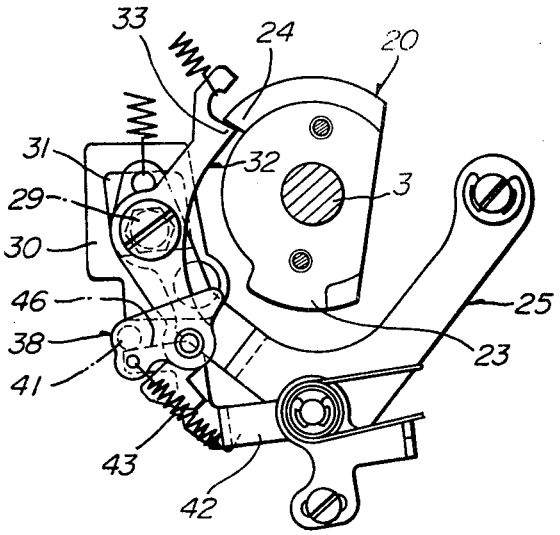

FIG. 5 shows a condition in which the cam portion 23 rotates in the counterclockwise direction together with the upper shaft 3 and engages the contact portion 40 to rotate the actuating member 38 in the clockwise direction until the pin 41 leaves from the flat end port 46 of the lever 42 and is pressed against the pawl 32. Since the cam portion 23 further rotates to turn the contact portion 40 farther in the clockwise direction and pushes it out of the path of the cam portion 23, and the contacting portion 40 engages the outer periphery of cam 23 as shown in FIG. 6, the pawl 32 is turned around the pivot screw 34 on the holder 25 in the clockwise direction against the tension of spring 36 together with the actuating member 38. As the result the upper corner 33 of the pawl is shifted into the path of the cam portion 24 and is engaged by the cam 24, but the cam is not instantly stopped by the pawl 32, because the corner 33 is pushed by the rotating cam portion 24 and the holder 25 is rotated in the counterclockwise direction around the pivot axis 26 against the tension of the spring 28 until the nut 29 on the free end 27 of the holder 25 is pressed against the lower edge of the square hole 31 of the fixed stop 30 as shown in FIG. 7. Thus the main shaft 3 of the sewing machine is stopped in this position. In this instance the actuating member 38 is shifted to a position spaced from the cam portion 23 and turned in the counterclockwise direction by spring 43, until pin 41 on the actuating member 38 engages the flat portion 33 at the end of lever 42.

The above operation of the constituent part has been effected when the pedal 2′ of the machine controller 2 is pressed down to supply the electric current to the motor.

Figure 4:
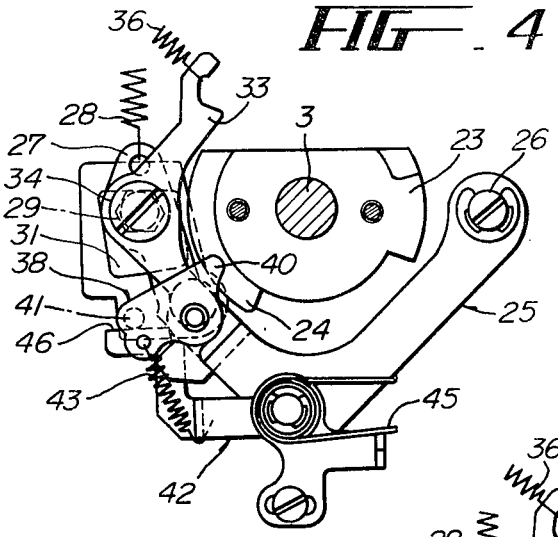
FIGS. 4 to 8 show the machine stopping device in various operating positions.
Figure 8:
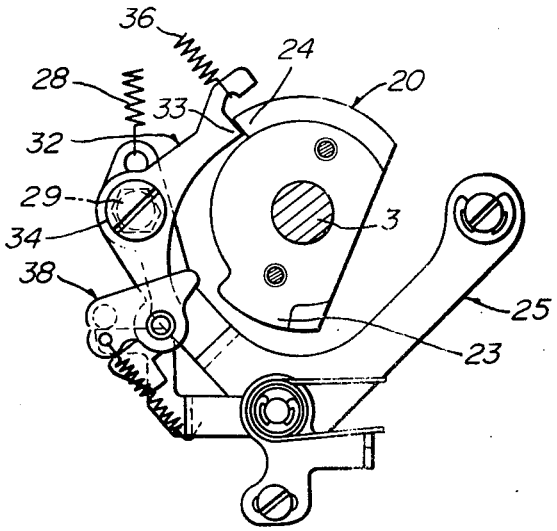

When releasing the controller pedal 2′, no rotational force is important to the main shaft 3 of the sewing machine and consequently the spring 28 pulls upwards the left end portion of the holder 25 to rotate the same in the clockwise direction until the nut 29 engages the upper edge of the square hole 31 of the stopper 30. Consequently the pawl 32 rotates the cam 24 with its upper corner 33 for a little distance in the clockwise direction. At the same time the spring 36 turns the pawl 32 in the counterclockwise direction about the pivot axis 34 and shifts the upper corner 33 of the pawl 32 out of engagement cam with portions 24, and then the actuating member 38 returns back to the first operative position where the contacting portion 40 is located in the path of the cam portion as shown in FIG. 4. According to the invention, the main shaft 3 of the sewing machine stops completely at a position to which the main shaft is turned counterclockwise together with the stop cam member 20 as shown in FIG. 8. If the stop position of the main shaft 3 is predetermined to correspond the upper dead point of the needle at which the needle is stopped, it would be possible to stop the needle at the upper dead point thereof at each cycle of rotation of the main shaft. Then the controller pedal 2′ is pressed down again, the above mentioned operation of associated parts is repeated and the upper shaft 3 is stopped at the same position is repeated and the upper shaft 3 is stopped at the same position after one rotation thereof. By repeating this operation, the intermittent stitching can be carried out as the main shaft of the sewing machine is stopped at a predetermined position to stop the needle at the upper dead point thereof per rotation of the main shaft.

With reference to FIGS. 9–11, the second embodiment of the instant needle stopping device will be explained. When the operating portion 56 of the switch 55 is set to Intermittent position, the lever 50 is moved down and as the result, the lever 42′is turned in the clockwise direction by the action of torsion spring 45′ until the lever 47′ is stopped by a pin 60′ fixed to the machine frame. Consequently the lever 42′ pushes the pin 41′ on the actuating member 38′ with the flat portion 46′ to shaft the contact portion 40′ of the actuating member 38 into the path of the cam portion 23′ as shown in FIG. 11. Since the cam portion 23′ makes one revolution from the position as shown in FIG. 9, and pushes the contact portion 40′ out of the path of the cam portion 23′ after one revolution thereof, the actuating member 38′ is turned in the clockwise direction until the pin 41′ is pressed against the pawl 32′. Then this pawl 32′ is turned in the clockwise direction against the force of the spring 36′ together with the member 38′. Consequently the upper engaging corner 33′ of the pawl 32′ is brought into the path of the cam portion 24′, and engages the cam portion 24′ of the step cam member 20′ to stop the main shaft 3′ of the sewing machine. However, at the instance, since the contact portion 40′ of the actuating member 38′ is still pushed by the cam portion 23′ in the clockwise direction, the pawl 32′ is still being turned in the clockwise direction. Namely the corner 33′ partly engages the cam portion 24′ as shown in FIG. 9. The cam portion 24′ rotates a little farther while the contact portion 40′ of the actuating member 38′ is spaced from the cam portion 23′, but due to the mutual action between the cam portion 24′ and the corner 33′ the cam portion 24′ and the upper engaging corner 33′ of the pawl 32′ completely engage each other as shown in FIG. 10. In this state, the pawl 32′ will not be disengaged from the cam portion 24′ by the action of spring 36′ as long as the main shaft 3′ of the sewing machine is supplied with driving power. Namely, so long as the controller pedal 2′ is pressed down, the sewing machine is kept stopped in the condition as shown in FIG. 10. When the controller pedal is released, no rotational force is applied to the main shaft 3′ and accordingly to the stop cam member 20, and as result, pawl 32′ is pulled by the spring 36′ and brought out of the engagement with the cam portion 24′. Thus the sewing machine stops. In the constant case, the contact portion 40 of the actuating member 38′ is again brought into the path of the cam portion. When the control pedal 2′ is pressed down again, the same operation of associated parts is repeated to stop the sewing machine at a fixed position. Therefore, by repeating the operation of the controller 2′, stepwise rotation of the main shaft for the intermittent stitching as in the first embodiment is produced.

I claim:

1. In a sewing machine, a combination comprising a machine frame; a main shaft rotatably mounted in said machine frame for reciprocating a needle during rotation of said main shaft; drive means for rotating said main shaft; control means movable by an operator between a first position actuating said drive means and a second position deactivating the drive means; stopping means movable between an active position stopping said main shaft and an inoperative position; means cooperating with said stop means for moving the same from said active to said inoperative position when said control means is moved to said second position; further means cooperating with said stopping means for moving it back to its active position while said main shaft makes one revolution upon moving said control means to said first position; and selecting means selectively operable between a plurality of positions, in one which it renders said stopping means operative so that the latter stops said main shaft and in the other of which it renders the stopping means inoperative so that the main shaft rotates continuously when said control means actuates said drive shaft.

2. A combination as defined in claim 1, wherein said control means is a foot-operated switch having a foot pedal which when pressed downwardly moves said control means to said first position and when released moves said control means to said second position.

3. In a sewing machine, a combination comprising a machine frame; a main shaft rotatably mounted in said machine frame for reciprocating a needle during rotation of said main shaft; drive means for rotating said main shaft; control means for actuating and de-actuating said drive means; stopping means for stopping said main shaft in a predetermined position while said drive mean are actuated by said control means, said stopping means comprising a first cam mounted on said main shaft for rotation therewith, a pawl cooperating with said first cam to stop said main shaft, a second cam mounted on said main shaft for rotation therewith, an actuating member turnably mounted on said pawl and cooperating with said second cam to shift said pawl to a position for cooperation with said first cam, and spring means yieldably biasing said pawl and said actuating member to an inoperative position; and selecting means selectively operable to render said stopping means operative and inoperative.

4. A combination as defined in claim 3, wherein said stopping means further comprises a holder turnably mounted on said machine frame, said pawl being turnably mounted on said holder, spring means yieldably biasing said holder to a predetermined position, and stop means for limiting the movement of said holder.

5. A combination as defined in claim 3, wherein said selecting means comprises a manually operated member, a first lever, and a second lever, said first lever being turnably mounted on said machine frame between said actuacting member and said second lever and adapted to act with one end thereof on said actuating member, said second lever being shiftably arranged between said first lever and said manually operable member, one end of said second lever being operatively connected with said manually operated member and the other end thereof being adapted to cooperate with the other end of said first lever, so that with manipulation of said manually operable member, the actuating member may be shifted by said first and said second lever into a position to cooperate with said second cam and to a position to be inoperative.

6. A combination as defined in claim 5, wherein said selecting means further comprises a detaining mounted on said second lever and cooperating with said manually operable member to detain the first and second levers in an operative position, to thereby detain said actuating member in an operative position.

* * * * *